US005374018A

United States Patent [19]

Daneshvar

[11] Patent Number: 5,374,018

[45] Date of Patent: Dec. 20, 1994

[54] D. PAD

[76] Inventor: Yousef Daneshvar, 21459 Woodfarm, Northville, Mich. 48167

[21] Appl. No.: 994,514

[22] Filed: Dec. 21, 1992

[51] Int. Cl.[5] ..... B68G 5/00

[52] U.S. Cl. ..... 248/118; 248/918

[58] Field of Search ..... 248/118.1, 118.3, 118, 248/176, 918, 676; 400/715; 340/711, 709

[56] References Cited

U.S. PATENT DOCUMENTS

| | | | |
|---|---|---|---|
| 4,482,063 | 11/1984 | Berke | 248/118 X |
| 4,511,111 | 4/1985 | Godfrey | 248/918 X |
| 4,545,554 | 10/1985 | Latino | 248/118.1 |
| 4,621,781 | 11/1986 | Springer | 400/715 X |
| 4,776,284 | 10/1988 | McIntosh | 248/918 X |
| 4,913,390 | 4/1990 | Berke | 248/176 |
| 5,040,760 | 8/1991 | Singer | 248/918 X |
| 5,125,606 | 6/1992 | Cassano | 400/715 X |
| 5,131,614 | 7/1992 | Garcia | 248/118 |
| 5,170,971 | 12/1992 | Schaeffer | 248/118.1 |

*Primary Examiner*—J. Franklin Foss

[57] ABSTRACT

A support pad for a keyboard has a number of features including a cover that is attached along the rear edge of the pad and can be pulled over a keyboard on the pad, a riser system for achieving desired height and angulation, and a wrist and/or palm support pad. The riser system is disposed between the support pad and an underlying horizontal surface. One or more inflatable balloons are used to set the height and angulation of the wrist and/or support pad. The support pad for both the keyboard and the palms and/or wrists has an upper exterior layer below which one or more layers of soft plastic bubbles are disposed.

23 Claims, 6 Drawing Sheets

D. PAD

BACKGROUND AND SUMMARY OF THE INVENTION

The computer is part of today's life, and we are faced with using them in our jobs, and at times even at home. I believe it would be hard to find an advanced office in the U.S. that does not have a computer in use. However use of computers and keyboards is not totally benign and easy, and some difficulties have occurred. One of my patients developed carpal tunnel syndrome which was believed to be due to heavy use of a computer keyboard. In my experience other problems also occur, such as pain in areas of the hands that touch the hard parts of the desk or the keyboard of the computer. Since people are different, I believe it is not possible to make a single keyboard that will match and be perfect for everyone. The fact is that people have different sizes, body figures, make-up, sexes, ages, etc. Some people are twice as tall as others, or even more. Some have about twice the width as others. This is true about other parts of their bodies and arm sizes too. The difference between the hands of men and women is obvious. Most men have big bulky hands and most women have slim smaller hands with less muscles. Even in one sex and family the difference can be noted; my son puts the keyboard in a different position than I do. So even in one home and one family, the husband, the wife, the girls and boys, the older and younger children may have different choices for the keyboard and its height, angulation, etc.

Another important point that I want to mention is that from my own experience a single person may wish to use a keyboard differently when one part of the hand has been under pressure for awhile and different muscles and parts of the hands previously used may be wished to be left free for awhile. However in practice, there is not much choice in keyboards and their sizes. Even their height cannot be adjusted easily, which I believe is a part of the problems with the present keyboards. So when we consider people with different sizes, arm lengths, back bone and back structure, the fact is that the chair and the desk they use are many times different and at times not adjustable as they wish. Then we reach the conclusion that it will be advantageous, and even at times necessary, to have a keyboard that allows its height to be adjusted, which is not possible with the units that I have seen. This is also true about angulation between the keyboard and the user. It is true that most keyboards have a couple of snaps in their bottom that can be raised to cause angulation of the keyboard. But it is only one choice and not more. Therefore I believe it will be very useful to have a unit added that gives a choice of angulation between the keyboard and the user which is not possible with present units.

Another major problem that I have noticed during my work with the computer is that the rear part of my palms sits against and touches the edge of the keyboard and the table, and this gets so painful that I have to stop many times to avoid pain. To solve this problem I once used a piece of plastic with bubbles that was used in packing a unit which was shipped to us. I noted that it was helpful to some degree, but not much, and the bubbles also popped since they were not designed for this job and were not protected properly from localized pressure from the base of my palms.

These observations gave me the belief that there is a need for a unit to give more freedom, choice and support for keyboard users, and this made me present my own unit for this use.

This unit is made from combinations of soft and hard plastic, and may have sponges in its construction as well as mosaics of bubbles and balloons and elastic bands. This unit has a rectangular area in its top surface that matches and accepts the keyboard of a computer. This place may also be covered by a thin layer of plastic which has mosaics of bubbles inside it, which I believe causes dissipation and absorption of some of the pressure from the tips of the fingers.

In front of this place there is another place that allows the palms and part of the wrist in some cases to be placed. This area has a rectangular shape and is covered by a soft pad. The soft pad is either permanently attached to this unit and area, or it can be removably and exchangeably stuck or placed in that area. For this purpose, this unit has a flat surface in its front that has patches of Velcro$_{TM}$ to allow the matching pieces of Velcro$_{TM}$ from the bottom of the soft pad to stick to it and hold it in place. This allows different soft pads to be stuck and to be exchanged easily. The surface of the soft pads can be flat, or convex, or concave. Also it will allow pieces with different thickness and softness to be chosen.

This invention allows the height of the keyboard as well as its angulation to be adjusted, and the parts that are touched to be softer. The unit also has an empty space in its bottom like a rectangular flat space that allows multiple pieces of matching boards to be placed in it. These boards have different shapes; some are like regular flat boards, while others have the shape of smooth flat wedges. These boards can be connected to each other by simple ways to make a unit with adjusted height and angulation to be placed under the keyboard. The soft pad in front is made from mosaics of soft plastic bubbles covered by a soft non-irritant plastic that can have different shapes to allow the base of the palms to be situated on it for better and softer feelings. This prevents the hands from touching the hard part of the table as well as the hard edge of the keyboard. Dust also is dislikeable and may gradually damage the unit, and to prevent its accumulation on the keyboard, a cover is connected to the rear end of this unit that can be pulled to cover the keyboard from dust.

DESCRIPTION OF THE PREFERRED EMBODIMENT

Figure 1:
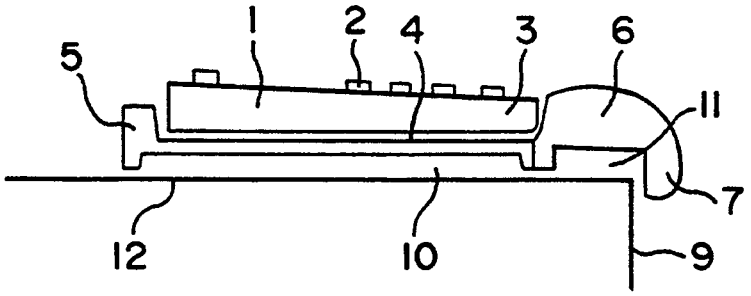
FIG. 1 is a side elevational view as taken along the cross section line 1—1 in FIG. 2.
Figure 2:
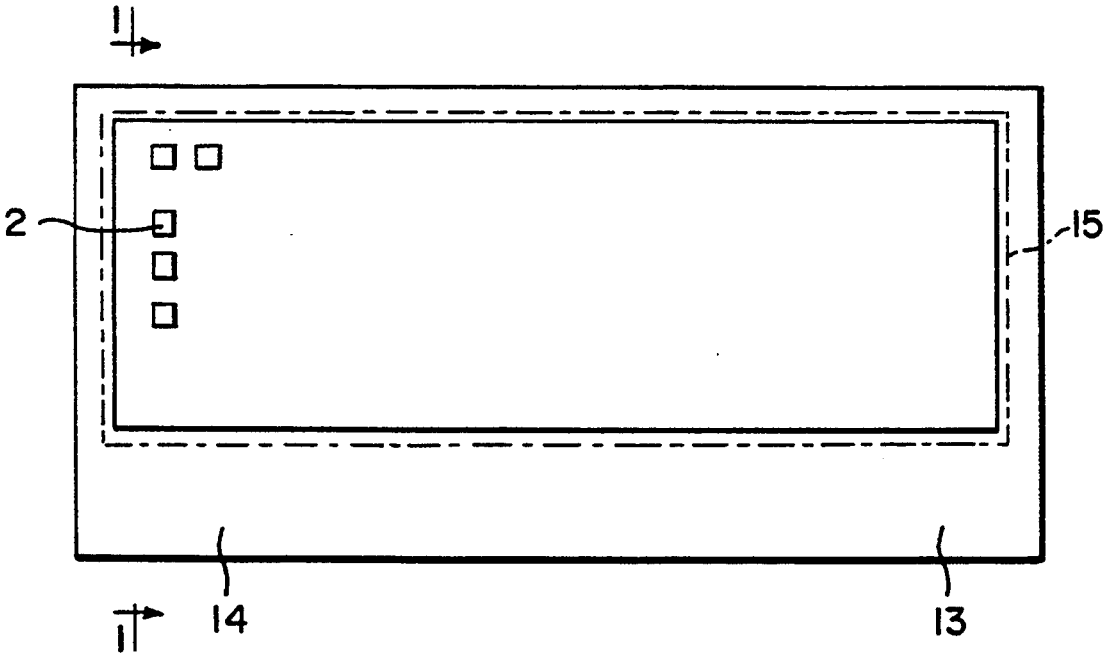
FIG. 2 is a top plan view of a first embodiment of my keyboard cradle with support pad.
Figure 3:
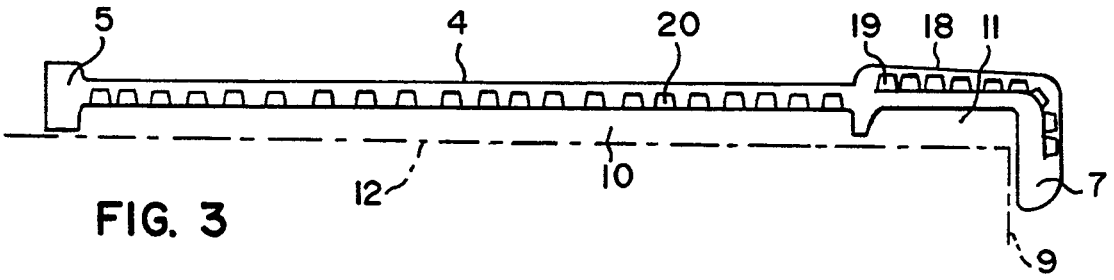
FIG. 3 is an enlarged view of FIG. 1 showing more detail.

FIGS. 1–3 show a first embodiment of a keyboard cradle and support pad (D.Pad). In FIG. 1, the unit is sitting on the table and under the keyboard. The user is to sit to the right side and the monitor to the left. The top of the table is shown by 12, and the user side of the desk by 9. The keyboard is shown by 1 and the end of keyboard close to the user by 3. The keys on the keyboard are shown by 2. The body of the D.Pad that allows the lower part of the palm to sit on it is shown by 6. It extends to make a curb and end at piece 7. The surface of the D.Pad that the keyboard sits on is shown by 4 and the end of it which is close to the monitor is shown by 5. The place for the right palm is shown by 13, and for the left palm by 14. The rim of the cradle that the keyboard sits on is shown by broken line 15. The surface of the body of the D.Pad that allows the lower part of the palm to sit on it is shown by 18 which extends to make the curb and end at piece 7. Here surfaces 18 and 4 both are standing on a mosaic of small bubbles of plastic that are shown by 19 and 20. Two empty spaces 11, 10 allow a number of matching boards (such as ones shown in FIGS. 5 and 6) to be placed under them. The placement of these matching boards allows the height of this part to be adjusted. Naturally if higher boards are placed, the part of the unit on it will be raised, and if a thinner piece is placed, it will be lower.

Figure 4:
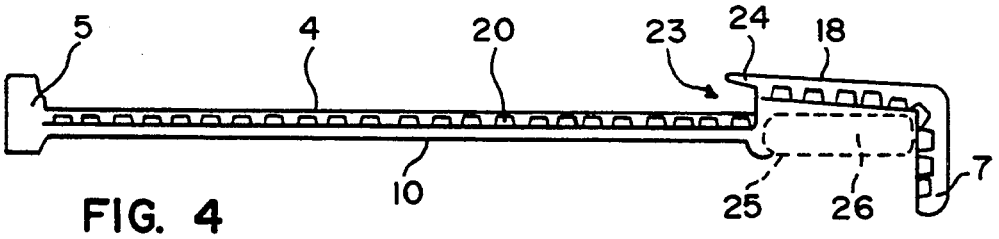
FIG. 4 is view similar to FIG. 3 showing a modification.

In FIG. 4 the place for placement of the keyboard is basically the same as in FIGS. 1–3. However the place for place of the palm has a difference. An extension 24 has been added that overlaps the top of the front rim of the keyboard when it is placed on this unit. Numeral 23 shows a space where the front rim of the keyboard will be placed. Another difference is shown by numerals 25 and 26. Numeral 25 is the surface of a flat balloon that is placed in this place, and numeral 26 shows the center space of this balloon. This balloon is inflated to allow the height of the part for the palm placement to be adjusted. The balloon can also absorb some shock and helps to give a better feeling.

Figure 5:
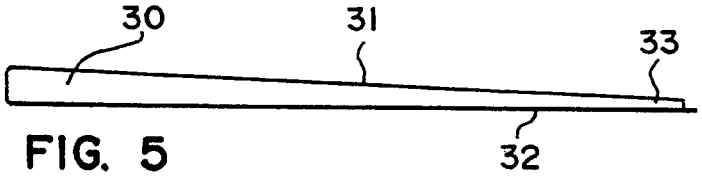
FIG. 5 is a side elevational view of a board for inclining the cradle.

FIG. 5 shows a board that is to be placed under the keyboard place in space 10. This view shows that this board has a thicker end 30 to one side and a thinner end 33 to the other. The upper surface is shown by 31 and the lower surface by 32.

Figure 6:
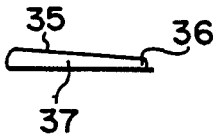
FIG. 6 is a side elevational view of a board for inclining the support pad.

FIG. 6 shows a smaller board that is to be placed under the palm place in space 11. This view also shows that this board has a thicker end 35 to one side and a thinner end 36 to the other. The body of this board is shown by 37.

Figure 7:
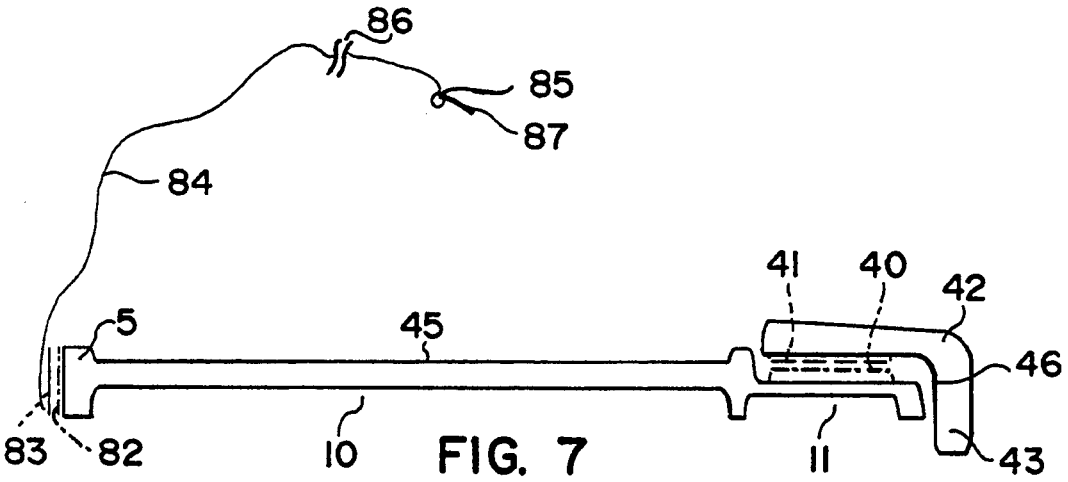
FIG. 7 is a view in the same direction as FIG. 3 showing another embodiment.
Figure 8:
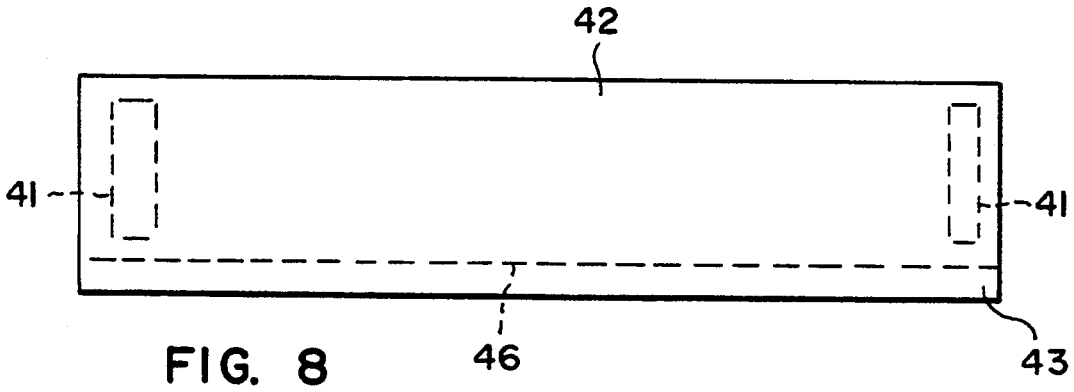
FIG. 8 is a top plan view of the support pad of FIG. 7 by itself.

FIGS. 7 and 8 show a unit like FIG. 3 but it has a flat surface that accepts a soft pad for the palms. This flat surface has a patch of Velcro$_{TM}$ 40 that matches and accepts Velcro$_{TM}$ patches 41 on the bottom of soft pad 42, that curves at bend 46 to make a piece 43 for covering the edge of the table. In the rear end of this unit, a protective layer is stuck to the rear wall of the unit by Velcro$_{TM}$ patches. One patch 82 shown by dot and dash line is stuck to the rear surface of the unit, and the matching patch 83 shown by dashed line is stuck to the inner surface of a cover 84 which has an end line 85 which may have a rim of elastic to allow it to be held in place. The broken place 86 allows the cover to be shortened for illustration in this figure. A tab 87 makes it easier for the cover to be pulled over the keyboard.

Figure 9:
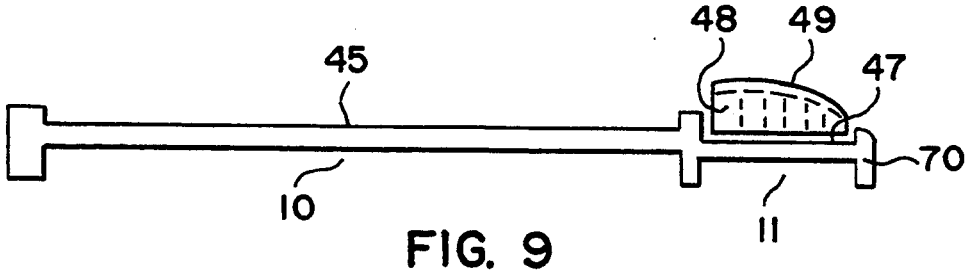
FIG. 9 is a view similar to FIG. 7 showing a modification.

FIG. 9 shows a unit similar to the one in FIG. 7, except that the place for patches 40 has a small wall 70 that makes a rectangular space 47 that accepts a soft piece shown by 48–49, to be shown further in FIGS. 10–14.

Figure 10:
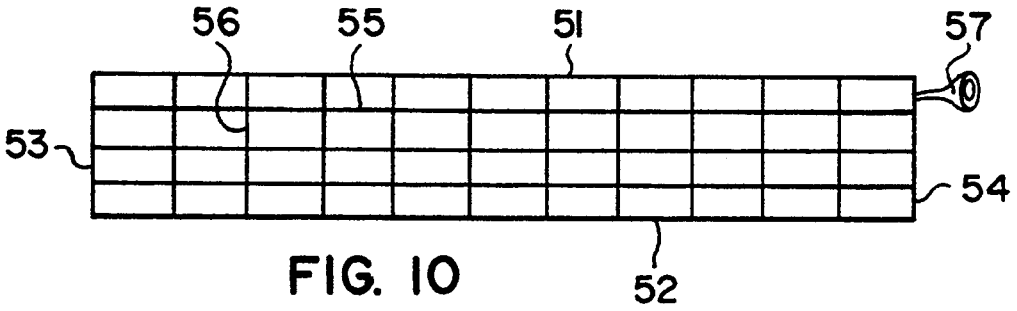
FIG. 10 is a plan view showing one construction for a support pad.

FIG. 10 shows a soft pad made from balloons. This is to show how this piece can be made from combinations of balloons. This view shows that combinations of walls of plastics, the vertical such as 56, and horizontal such as 55, divide this piece into many smaller compartments that can have common or different inflation ports. One is shown here by 57. This piece has a rear rim 51 that is placed close to the monitor and a front rim 52 that is closer to the user. Numeral 53 shows the left side, and numeral 54 shows the right side of the unit.

Figure 11:
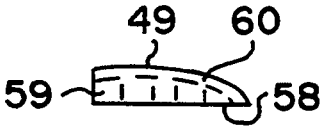
FIG. 11 is a side elevational view of another support pad.
Figure 13:
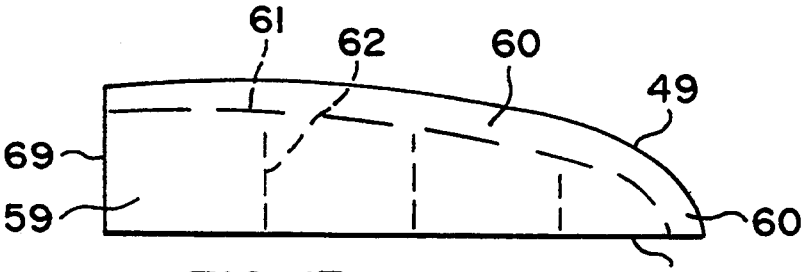
FIG. 13 is an enlarged view of FIG. 11.

FIGS. 11 and 13 show a soft pad that has a convex upper surface 49 and a lower surface 58. Surface 58 is placed in space 47 of FIG. 9. Numeral 60 shows a layer of soft material covering a compartment 59.

Figure 12:
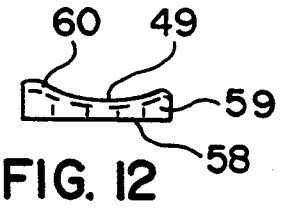
FIG. 12 is a side elevational view of a support pad.
Figure 14:
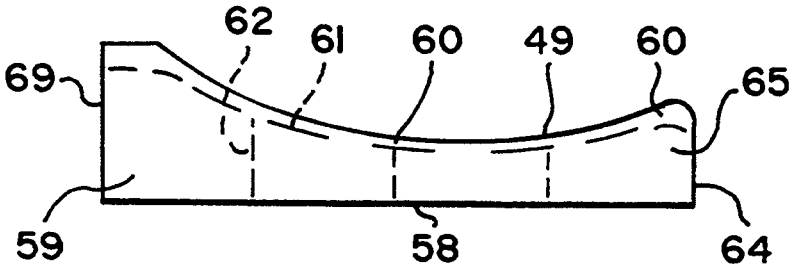
FIG. 14 is an enlarged view of FIG. 12.

FIGS. 12 and 14 are very similar to FIGS. 11 and 13, except this pad has a concave upper surface 49. Soft layer 60 may be made from a layer of plastic bubbles or a soft plastic layer or some other material for covering the underlying compartments 59 and similar and related parts. A wall 61 is between this cover layer and the roof of the compartments 59. A wall 62 divides the space under the cover layer 60 into multiple compartments 59. Numeral 69 shows the rear wall of this pad that will be closer to the monitor, and numeral 64 shows the wall of this pad which is closer to the user.

Figure 15:
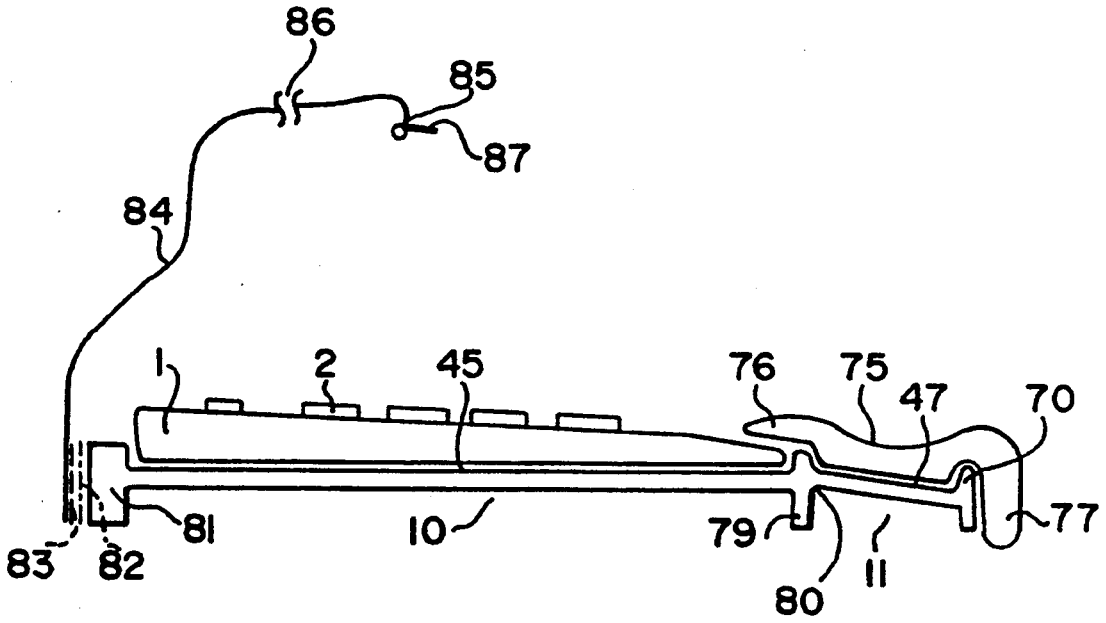
FIG. 15 is a view in the same direction as FIG. 3 showing still another embodiment.

FIG. 15 shows a unit very similar to the one shown in FIG. 9, except this unit has a soft pad that has an extension 77 which goes over the edge of the table to support the palm in that area. This unit has a short wall 70 which fits the lower surface of the soft pad to prevent it from being displaced outward. This Figure also shows a flat extension 76 that covers the hard surface of the keyboard. Also shown are bottom pieces 79 and 81 which can be soft with a rubbery type surface to prevent the unit from slipping on the desk. The angle 80 may be also soft and flexible. In this Figure, keyboard 1 is placed on place 45. At the rear end of this unit, a protective layer is stuck to the rear wall of the unit by Velcro$_{TM}$ patches. One patch 82 is shown by dot and dash line and is stuck to the rear surface of the unit; the matching patch 83 shown by dashed line is stuck to the inner surface of cover 84.

Figure 16:
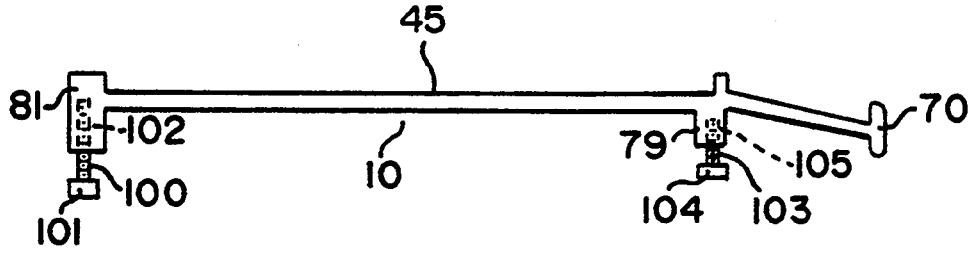
FIG. 16 is a view similar to FIG. 15 showing a modification.

FIG. 16 is very similar to FIG. 15, except for screws in the corners that are used to adjust the height of the unit. Here screw 100 has a rubber tip 101, and is screwed inside the corner of the unit. The piece inside is shown by 102. A similar unit is shown at the right side in the bottom of base 79. Screw 103 has its rubber tip 104 that is partially screwed inside the corner of the unit. The inside piece is shown by 105.

The units that have been shown in the drawing Figures, are made from combinations of soft and hard plastic, that may have sponges in their construction, as well as mosaics of bubbles, balloons, and elastic bands. Each unit has a rectangular cradle in its upper surface with a size to match the bottom of the keyboard of the computer, and covered by a soft pad with mosaics of soft bubbles on it.

Each unit also has an empty space in its bottom that allows multiple pieces of matching boards to be placed under it. These boards will have different shapes; some will be like regular flat boards, while the others will have the shape of smooth flat wedges. These can be connected to each other by simple ways such as having raised poles in one surface and matching empty places in the other surface for those poles to be inserted inside them. The boards can be stuck to each other and a band of elastic may go around them to secure their attachment. The addition of various boards will allow combinations of shapes with different height and angulations to be made, and then placed in the matching board space under the keyboard, to give the desired height and angulation to the keyboard.

Alternatively the height and angulations of this unit can be changed by use of four screws as described in FIG. 16. Rotation of these screws changes their height outside of the keyboard and allows the height of the unit to be adjusted. This method has the advantage that if the surface of desk or the bottom of the keyboard does not match and it tilts to the corners with pressure to one corner, these screws will easily adjust that. The height and angulation control can also be done by other simple methods such as having metal poles that are held by a screw in the sides of the corners of the unit. The place where these poles are screwed to the sides will allow the height of the unit to be controlled, as well as some other similar techniques.

The flat surface for accepting the soft pad is about 4 to 8 cm or so wide and about 45 to 60 cm or so long. It has a couple of bands or patches of Velcro$_{TM}$ stuck on its upper surface that allow the bottom surface of the soft pad with matching pieces of Velcro$_{TM}$ to be stuck to it.

The soft pad consists of one or more layers of mosaics of soft plastic bubbles, sandwiched between two soft plastic layers. The upper layer is non-irritant plastic to give a soft, nice filling to the hands when they touch it. The upper and lower cover of these soft plastics are resistant and durable. The upper surface of this pad can have any of several different shapes such as concave, flat, or convex shape to allow the base of the palm to be situated on it for better and softer feeling. These pieces may have a rounded edge 46 that bends down to cover the edge of some desks and tables that otherwise will pressure the base of the palm of the hands and hurt them so that with this piece in place, it will prevent the hands from touching the hard part of the table as well as the edge of the keyboard. This piece has matching pieces of Velcro$_{TM}$ that allow it to be stuck to Velcro$_{TM}$ patches on the bottom piece. This system allows the user to choose any of different units he or she prefers and also to change it when his or her hands got tired from that particular unit. (I believe it is important to consider that a person may get tired of one particular unit or another since after all still there will be some points of the hands that will be pressed by any one unit more than the others so that they get more tender and painful. Therefore it will be very helpful in my mind to have the chance of changing and rotating a particular unit with the others no matter how nice it may look in the beginning.) Also this system will allow a change if that part of the unit gets old and torn and needs to be changed by a brand new pad to work as a totally new unit. This will also allow the width of the pads, their thickness, and shapes to be changed easily too. Units made from different materials, such as with a lamb skin type of cover, can be placed on the surface of a soft pad, and pads with soft sponges can also be used. All are to allow a user to choose the best unit that matches his or hers need or taste, the best.

Another model of soft pad may have a long soft balloon in its base that will have an inflation port (57 in FIG. 10) for inflation of this balloon with air as well as filling it with different liquids such as water, inert oil, or a gel similar to silicon gel. This balloon may be divided by different walls (55, 56 in FIG. 10) into smaller compartments 59 (FIG. 13) (also the walls can be horizontal as well as horizontal and vertical) in order to give a shape and divide the pressure of the palms and also to prevent the balloon to be flat if one wall is perforated. These compartments may have a common inflation port or may be inflated by a separate inflation ports and have different groups connected to them. They may be inflated temporarily or permanently. The level of inflation and the pressure inside the balloons may be changed due to different amounts of air that will be inserted. The use of liquids is to give different filling such as water bed or the feeling of touching a silicon breast implant. The pressure of palms in this kind of construction will make the placement and shifting of the compartments to sides and their remodeling so that the unit (to some degree) will assume the shape of the outside of the palms and prevent constant severe pressure to one spot so that ideally the hands which are one of most important parts of the body would not feel bad with use of the keyboard. This balloon will be then covered by a soft layer shown by 60 in FIGS. 11–14. This layer may be made from a layer of soft plastic with bubbles covered by a soft layer of plastic or a layer of soft sponge and/or by a soft fabric such as lamb skin type material, or other synthetic materials.

In some models the soft pad may have a thin soft extension in its upper front edge such as 24 in FIG. 4 and 76 in FIG. 15 that will overlap the upper front edge of the keyboard to extend the soft surface over the edge of the keyboard.

In some models the soft pad may be part of the unit, instead of being separable such as shown in FIGS. 3 and 4.

A unit similar to one mentioned above can also be made to have a balloon incorporated in the bottom of the soft bubbles. This model is shown in FIG. 4 and the balloon is shown by 26.

Since the dust and dirt are not good for the keyboards, a layer of soft plastic cover is removably attached to the rear end of this unit either by adhesive or by use of Velcro$_{TM}$ patches. This cover will be pulled to the front to cover the surface of the unit to prevent dust from getting on it.

This unit may be made from different material soft plastic with some hard components on it. The body of this unit may be made from a sponge in order to give a shape that it then be covered by soft plastic that the whole unit will be flexible, or in some parts such as the flat surfaces the unit may have a hard plastic inside to give it the shape.

Alternatively a thin layer of hard plastic may make the skeleton of the unit to be covered by another layer of plastic. These are to use the presently available materials to make a nicer unit with the specified shape as possible. Naturally the color of the unit can be different and also the size of the unit and the relative sizes of the areas can be different to satisfy the needs and the tastes of the users.

What is claimed is:

1. A keyboard support for supporting a keyboard on a generally horizontal surface comprising,
   a keyboard support pad comprising a top surface and a bottom surface,
   keyboard-receiving means in said top surface for receiving a keyboard,
   means defining a riser cavity in said bottom surface,
   and riser means disposed in said riser cavity for supporting said support pad on such a generally horizontal surface at a desired height and angulation.

2. A keyboard support as set forth in claim 1 further including a palm and/or wrist support pad for supporting a person's palms and/or wrists while using a keyboard disposed in said keyboard-receiving means, said palm and/or wrist support pad having a top surface on which the palms and/or wrists rest and a bottom surface, said bottom surface of said palm and/or wrist support pad comprising a riser cavity and further riser means disposed in said palm and/or wrist support cavity for supporting said palm and/or wrist support pad on such a generally horizontal surface.

3. A keyboard support as set forth in claim 2 in which said further riser means comprises inflatable balloon means.

4. A keyboard support as set forth in claim 2 further including means for separably attaching said palm and/or wrist support pad to said keyboard support pad.

5. A keyboard support as set forth in claim 2 in which said palm and/or wrist support pad comprises a ledge that overlaps an edge of said keyboard-receiving means that is toward said palm and/or wrist support pad so that said ledge will overlie an edge of a keyboard disposed in said keyboard-receiving meats.

6. A keyboard support as set forth in claim 1 in which said riser means comprises plural riser elements arranged in a stack.

7. A keyboard support as set forth in claim 6 including means holding said plural riser elements in the stack.

8. A keyboard support as set forth in claim 2 in which said keyboard support pad and said palm and/or wrist support pad meet at an angle that is flexible.

9. A keyboard support for supporting a keyboard on a generally horizontal surface comprising,
   a keyboard support pad comprising a top surface,
   keyboard-receiving means in said top surface for receiving a keyboard,
   and a palm and/or wrist support pad for supporting a person's palms and/or wrists while using a keyboard disposed in said keyboard-receiving means, said palm and/or wrist support pad having a top surface on which the palms and/or wrists rest and a bottom surface, and said palm and/or wrist support pad comprising inflatable interior chamber means that can be inflated to a desired degree of inflation for providing a desired degree of underlying support of said top surface of said palm and/or wrist support pad.

10. A keyboard support as set forth in claim 9 in which said inflatable interior chamber means comprises a balloon disposed within said palm and/or wrist support pad.

11. A keyboard support as set forth in claim 9 in which said inflatable interior chamber means comprises multiple inflatable chambers.

12. A keyboard support for supporting a keyboard on a generally horizontal surface comprising,
   a keyboard support pad comprising a top surface,
   keyboard-receiving means in said top surface for receiving a keyboard,
   and a cover for covering a keyboard in said keyboard-receiving means, said cover comprising an edge portion that is attached to an edge portion of said keyboard support pad for holding such cover edge portion while said cover is pulled to cover such a keyboard.

13. A keyboard support as set forth in claim 12 in which said cover further comprises elastic means in other edge portions thereof for holding the cover in covering relation to such a keyboard.

14. A keyboard support as set forth in claim 12 in which said edge portion of said cover is separably attached to said first-mentioned edge portion of said cover.

15. A keyboard support as set forth in claim 14 in which such separable attachment comprises a Velcro$_{TM}$ fastening system.

16. A keyboard support as set forth in claim 12 in which said edge portion of said keyboard support pad is behind such a keyboard relative to a person using such a keyboard so that the person pulls the cover toward him when covering such a keyboard.

17. A keyboard support as set forth in claim 12 further including adjustment screws at four underlying corners for adjusting the keyboard support pad to such a horizontal support surface.

18. A palm and/or wrist support pad for supporting a person's palms and/or wrists while using a keyboard, said support pad comprising a top surface on which the palms and/or wrists rest and a bottom surface, said bottom surface of said palm and/or wrist support pad comprising a riser cavity and riser means disposed in said cavity for supporting said palm and/or wrist support pad on horizontal surface at a desired height and angulation.

19. A palm and/or wrist support pad as set forth in claim 18 in which said riser means comprises inflatable balloon means.

20. A palm and/or wrist support pad as set forth in claim 18 further including a keyboard support pad that meets with said palm and/or wrist support pad at an angle that is flexible.

21. A palm and/or wrist support pad for supporting a person's palms and/or wrists while using a keyboard, said palm and/or wrist support pad having a top surface on which the palms and/or wrists rest, and inflatable interior chamber means that can be inflated to a desired degree of inflation for providing a desired degree of underlying support of said top surface of said palm and/or wrist support pad.

22. Support means for supporting both a keyboard and palms and/or wrists of a person using such a keyboard, said support means comprising a layer of material forming an upper exterior of said support means on which at least one of such a keyboard and palms and/or wrists of a person using such a keyboard rest, and one or more layers of soft plastic bubbles underlying said layer of material to provide underlying cushioned support for said at least one of such a keyboard and palms and/or wrists of a person using such a keyboard.

23. Support means as set forth in claim 22 further including inflatable balloon means underlying said one or more layers of soft plastic bubbles for setting a desired height for said upper exterior of said support means.

* * * * *